United States Patent [19]

Mårtensson et al.

[11] 3,977,591

[45] Aug. 31, 1976

[54] COVER STRIP FOR THE POURING OPENING IN A PACKING CONTAINER

[75] Inventors: Kjell Mårtensson, Malmo; Stig Löthman, Sodra Sandby, both of Sweden

[73] Assignee: AB Ziristor, Lund, Sweden

[22] Filed: June 16, 1975

[21] Appl. No.: 586,858

[30] Foreign Application Priority Data

June 28, 1974 Sweden ..... 7408566
Apr. 25, 1975 Sweden ..... 7504804

[52] U.S. Cl. ..... 229/7 R
[51] Int. Cl.[2] ..... B65D 39/04
[58] Field of Search ..... 229/7 R

[56] References Cited

UNITED STATES PATENTS

| | | | |
|---|---|---|---|
| 2,740,547 | 4/1956 | Huntting | 229/7 R X |
| 3,018,024 | 1/1962 | Foord | 229/7 UX |
| 3,101,879 | 8/1963 | M-Jagemberg | 229/7 R |
| 3,217,951 | 11/1965 | Paal | 229/7 R X |
| 3,281,009 | 10/1966 | Collie et al. | 229/7 R X |
| 3,353,738 | 11/1967 | Andreasson | 229/7 R |
| 3,355,059 | 11/1967 | Balocca et al. | 229/7 R X |
| 3,526,351 | 9/1970 | Goldstein | 229/7 R |
| 3,687,352 | 8/1972 | Kalajiam | 229/7 R |
| 3,819,043 | 6/1974 | Harrison | 229/7 R X |
| 3,900,155 | 8/1975 | Rausing et al. | 229/7 R |

FOREIGN PATENTS OR APPLICATIONS

| | | | |
|---|---|---|---|
| 219,313 | 2/1968 | Sweden | 229/7 R |

*Primary Examiner*—Davis T. Moorehead
*Attorney, Agent, or Firm*—Pierce, Scheffler & Parker

[57] ABSTRACT

The invention concerns a cover strip for the pouring opening of a packing container. The strip is provided with a weakening line for ease in tearing off the cover strip. The bottom part of the cover strip is attached to a wall of the container so that it remains on the container after the cover strip per se is torn off.

7 Claims, 4 Drawing Figures

COVER STRIP FOR THE POURING OPENING IN A PACKING CONTAINER

Figure 1:
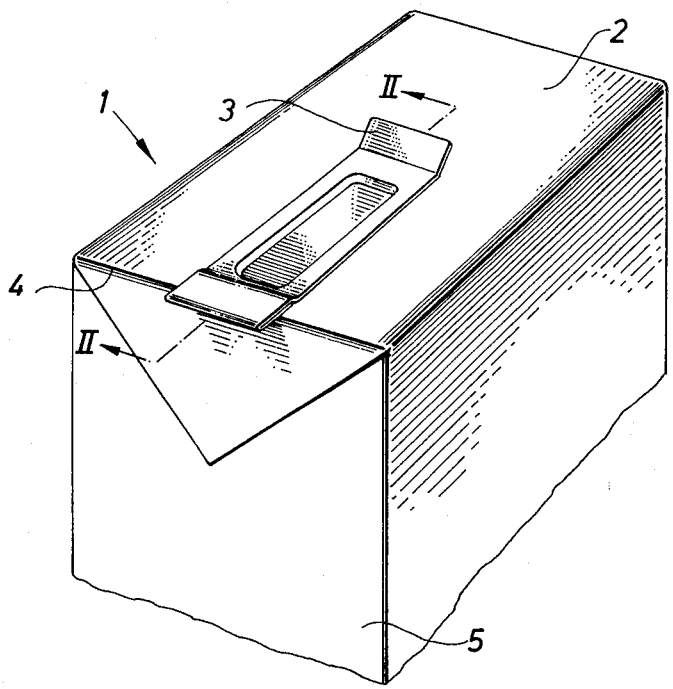

In the type of disposable packages (e.g. for beverages which are manufactured from plastic-coated paper or the like a large number of different types of openings exist for the emptying out of the contents. Thus, for example, pouring openings are known which are produced by the prizing open of a portion of the joint of the packing container, the cutting off of a corner, the folding out and tearing off of lugs etc. Quite often types of pouring openings also occur which consist of a hole punched out in the top side of the packing container, which is covered with a tear-off cover strip. This type of pouring opening offers a number of advantages, such as that it is possible to place the opening at any desired location, independently of lugs, joints and the like. The container will moreover be quite simple to open through the pulling away of the cover strip covering and closing the pouring opening, and the pouring opening normally gives a concentrated and readily directed steamer jet.

Certain pouring difficulties arise, however, when the pouring opening is placed in the vicinity of a folded edge on the packing container, which edge is not folded sharply to form a pouring lip but is rounded so that the jet will have the tendency to "follow" around the edge.

It is a further disadvantage that the jet runs a certain distance in contact with the outside of the packing container, which is not desirable if the filling material constitutes e.g. a beverage, since the outside of the package is wholly unprotected and can thus become contaminated during the transport of the packing container to the consumer.

It is an object of the present invention to overcome the abovementioned disadvantages.

It is a further object of the present invention to provide an easily openable pouring opening, which after opening shows good pouring characteristics, even if the opening is placed near a rounded edge on the packing container.

It is a further object to provide a clean pouring surface which is not exposed before the contents are poured out.

A cover strip for the pouring opening in a packing container is in accordance with the present invention characterized in that the strip in its front end is doubled, and is preferably folded along a transverse weakening line, that a bottom part of the strip resulting from this is attached to a side of the container and is adapted to remain on the package after the tearing off of the cover strip.

A first embodiment of the cover strip in accordance with the invention is further characterized in that the said weakening line is designed as a tearing indication, which is situated at, or some distance from an edge line of the container side provided with the pouring opening.

Since the bottom part of the strip which remains on the package extends somewhat outside one of the edges of the container side provided with a pouring opening, it will serve as a pouring edge and will allow the emptying of the container in a concentrated stream or jet over the said edge without spilling or dripping.

So that the remaining part of the strip should form an effective pouring edge, the tearing indication must be situated a few millimeters outside the edge of the packing container, and this has proved to involve a certain risk, since the projecting part of the strip may get caught in foreign objects and be torn off.

It is one object therefore that the part of the strip forming the pouring edge should be folded out to the position outside the package edge only in connection with the opening of the container. This is achieved in yet another embodiment in accordance with the invention which is characterized in that the weakening line is designed as a hinge link which is situated at, or a little distance inside the edge line, that a second weakening line is arranged substantially transversely across the top part of the strip and is designed as a tearing line, a portion of the cover strip situated between the weakening lines being adapted so that on tearing off of the cover strip it is folded out over the edge line and remains on the package in this position so as to serve as a pouring edge.

The invention will be described in more detail in the following with reference to the enclosed drawings which schematically illustrate two different embodiments of the invention.

Figure 2:
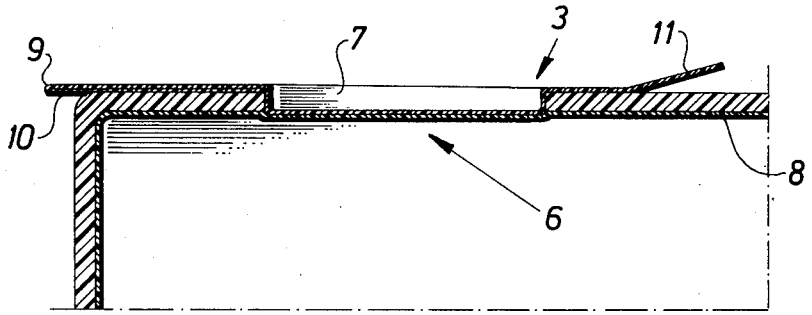
Figure 3:
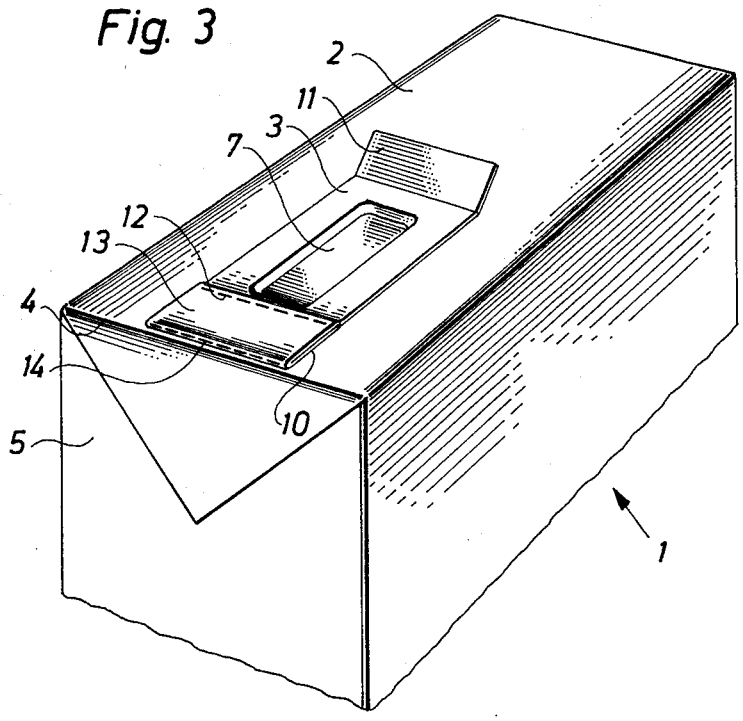
Figure 4:
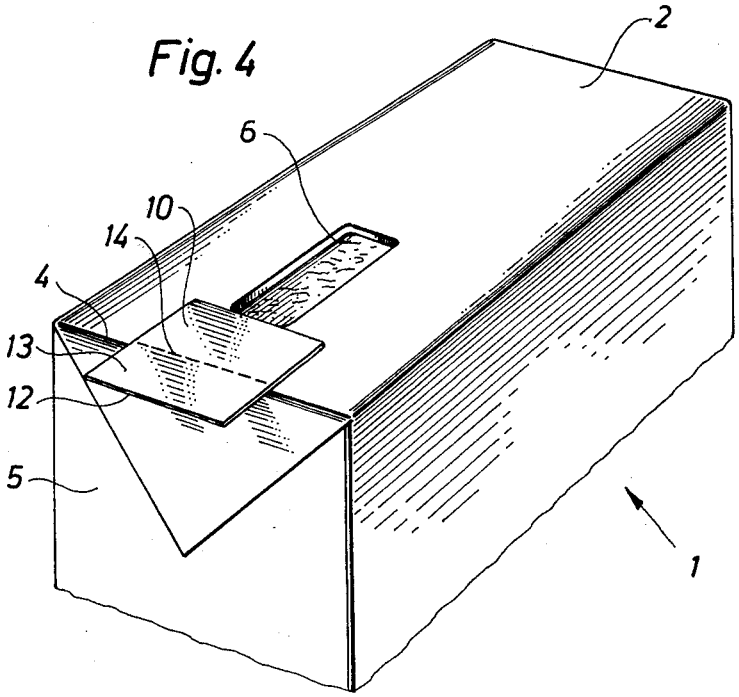

FIG. 1 shows the upper part of a packing container comprising a first embodiment of a cover strip in accordance with the invention, FIG. 2 is a section along line II-II in FIG. 1 and shows on a larger scale the pouring opening with the cover strip according to FIG. 1 applied to it, FIG. 3 shows the upper part of a packing container with a cover strip according to a second embodiment of the invention, and FIG. 4 shows the upper part of the packing container according to FIG. 3 after the removal of the cover strip.

The packing container 1 shown in the figures is of parallel-epipedic form and has an upper, preferably plane surface 2, in which a pouring opening closed by means of a cover strip 3 is arranged near an edge 4 between the upper surface 2 and one of the side surfaces 5 of the container.

In FIGS. 1, 2 and 3 the cover strip 3 is shown in applied position covering the pouring opening 6 of the packing container 1. The cover strip 3 comprises a centrally situated recessed part 7 of a shape corresponding to the shape of the pouring opening 6. The recessed part 7 is connected to a plastic layer or a plastic strip 8 (FIG. 2) which is attached to the inside of the packing material. The plastic strip 8 is applied after the pouring opening 6 has been made, and it thus covers and closes the same.

In the embodiment of the cover strip in accordance with the invention shown in FIGS. 1 and 2 the front part of the cover strip 3, situated at the front edge 4 of the package 1 is provided directly outside the edge with a transverse folding line 9 and the part 10 of the strip separated by the folding line 9 is folded back in underneath the main portion of the cover strip. The part 10 extends as far as the end of the pouring opening 6 situated nearest to the package edge 4, and is attached over its whole length, apart from the part situated outside the package edge 4, to the top part of the package. The folding line 9 represents a breaking indication or perforation.

The cover strip 3 is thus connected to the package only at two points, namely indirectly via the connection between the recessed area 7 and the inner plastic strip 8 and directly via the folded-in part 10 of the strip. On its rear part facing the central area of the top part 2 of the package, the cover strip 3 is provided with a folded up grip lug 11.

When a packing container 1 as shown in FIGS. 1 and 2 is to be opened so as to allow the pouring out of the contents, the lug 11 is gripped and pulled upwardly. In so doing, the plastic strip 8 will rupture along the hole edge, and the part of the strip 8 which is connected to the recessed area 7 of the cover strip 3 will follow the cover strip up, out of the pouring opening, so that the latter is opened. On continued tearing off of the cover strip 3 the same will rupture at the folding line 9 provided with a tearing indication, which means that the folded-in part 10 attached to the top side 2 of the package 1 will remain on the package. Thus two advantages are obtained, namely (1) that a marked edge can be created along the folding line 9, which can facilitate the pouring out of the contents of the container 1 and prevent the jet from following the package surface around the edge 4, and (2) the area on the top side of the package over which the jet flows is constituted of the remaining part 10, which before the opening of the package is protected by the main part of the cover strip 3 and cannot therefore be contaminated during the transport of the package.

The packing container 1 shown in FIGS. 3 and 4, apart from the detail design of the cover strip 3, is identical with the packing container shown in FIGS. 1 and 2, and parts corresponding to one another have the same reference numerals in the different figures.

This second embodiment (FIGS. 3 and 4) of the cover strip according to the invention lacks the folding line 9 described above and is provided instead at its front part situated at the edge 4 of the package 1 with a transverse weakening line 14 situated directly inside the edge 4 along which weakening line the strip is folded double so that a part 10 of the strip is situated underneath the main part of the cover strip 3. In this embodiment, the part 10 extends inwardly as far as the end of the pouring opening 6 situated closest to the package edge 4 and is attached over the whole of its length to the upper surface 2 of the package. Between the weakening line 14 and the recessed area 7 of the cover strip 3 there is a second weakening line 12, which also extends transversely across the cover strip, so that a small area or panel 13 is formed between the two weakening lines 14 and 12. The weakening line 12, is a series of more or less complete perforations of the material and is a tearing indication whilst the first weakening line 14 serves as a hinge.

When the packing container 1 (FIGS. 3 and 4) is to be opened so as to allow the pouring out of the contents, the grip lug 11 is gripped as in the embodiment mentioned previously and pulled in upwardly and forwardly direction. In so doing the plastic layer situated inside the packing material will be ruptured so that the recessed area 7 of the cover strip 3 is removed from the pouring opening. During the continued pulling of the cover strip, the transverse weakening line 14 will serve as a hinge, which means that the cover strip 3 including the area 13 is folded forwards and out over the edge 4 of the container. When the force is sufficiently strong, the cover strip 3 and the part 10 remaining on the package will be separated from one another at the weakening line 12, which means that the transverse part 13 will remain on the package in the folded-out position, as shown in FIG. 4. Through this a marked pouring edge will be created outside the edge 4 of the package 1, which facilitates the emptying out of the contents of the container, since the jet now does not tend to follow the outside of the package around the edge 4. Moreover, hygienic advantages are obtained from the fact that the top side of the package with which the jet comes into contact is constituted of the remaining cover strip parts 10 and 13, since these areas during transport and handling of the package have been protected by the cover strip 3 lying on top of them.

The two transverse weakening lines 14 and 12 of the cover strip which have been described must have an appropriate mutual strength ratio, if the cover strip is to function in the abovementioned manner. Thus it is necessary of course to give the transverse weakening line 14, which is to serve as a hinge, such a strength that the material does not break. At the same time, however, the strip area 13, after the opening of the package, remains in the folded-out position (FIG. 4). In practice the realization of the two weakening lines has not proved to cause any major problem in the manufacture of the cover strip, which has preferably been made of thin plastic material.

The function of the cover strip and of the fold-out pouring edge is associated moreover, on the one hand with the distance between the hinge 14 and the edge line 4 of the container, and on the other hand with the distance between the hinge link 14 and the tearing line 12. It is an advantage if the front edge of the folded cover strip, that is to say the hinge link 14, is placed a few millimeters inside the edge 4 of the packing container. Since at the same time as the container is opened the tearing line 12 serving as a pouring edge has to be a few millimeters outside the edge, this means that the distance between the weakening lines 14 and 12 depends directly on the distance between the weakening line 14 and the container edge 4. If the distance between the weakening line or the hinge 14 and the edge 4 of the packing container is 2 millimeters it was found to be appropriate to make the distance between the hinge 14 and the tearing line 12 4–6 millimeters. However, the dimension will have to be adapted of course in each case to the size of the package, the placing of the emptying opening and the radius of curvature of the actual container edge.

The cover strip 3 is made of a flexible and strong plastic material. The part of the cover strip which extends down into the pouring opening is provided at its lower edge with a projecting portion so as to make possible a re-closure of the package through "press-fastener effect".

In the embodiment according to FIGS. 1 and 2 it is not necessary for the double front end to be produced by the folding in of the strip end, but it can also be created by a separate strip part being attached to the underside of the front end of the cover strip before or in connection with the application of the cover strip to the package. The adhesive power between on the one side the cover strip and on the other side the strip part and the package must be adapted so that the strip part effectively remains on the package when the cover strip is torn off.

The advantages of using the cover strip in accordance with the invention are specially evident in packages for e.g. milk, since in such packages great demands are made on cleanliness as well as on the facility to pour out and dispense the milk without spilling and splashing.

We claim as our invention:

1. In a packing container having a pouring opening in the top thereof, the improvement comprising a cover strip for the pouring opening, said cover strip comprising an inner portion releasably secured over the pouring opening, an intermediate portion extending outwardly from the pouring opening and an outer portion folded under said intermediate portion and extending substantially back to the pouring opening, at least part of the outer portion being secured to the top of the packing container, said intermediate portion being provided with a transverse tearing indication, whereby when the inner portion of the cover strip is released from the top of the packing container to uncover the pouring opening for access to the contents thereof, at least said inner portion is separated at the tearing indication from the remainder of the cover strip including the outer folded portion which remains secured to the top of the packing container and provides a sanitary path for the contents when poured from the packing container.

2. In a packing container as claimed in claim 1 the improvement wherein the intermediate portion of the cover strip extends outwardly beyond the outer edge of the top of the packing container and wherein the transverse tearing indication is located at the outer end of the intermediate portion of the cover strip.

3. In a packing container as claimed in claim 1 the improvement wherein the intermediate portion of the cover strip extends substantially to the edge of the top of the packing container and wherein the transverse tearing indication of the intermediate portion is located at the inner end thereof and adjacent the pouring opening whereby when the inner portion is removed from the pouring opening, said intermediate portion will be folded outwardly beyond the edge of the container as a continuation of said outer portion to form the path for the contents of the packing container, and said inner portion will be separated from said intermediate portion at the tearing indication.

4. In a packing container as claimed in claim 1 in which the packing container is provided with an inner lining of a plastic material inside the top of the container, the improvement wherein said inner portion of the cover strip is depressed into the pouring opening and is secured to the inner lining so that the inner lining will be ruptured when the inner portion of the cover strip is removed from the pouring opening.

5. In a packing container as claimed in claim 4 the improvement wherein the depressed inner portion of the cover strip is releasably engageable with the edge of the pouring opening to permit said inner portion to be reinserted for a substantial reclosure of the packing container.

6. In a packing container as claimed in claim 1 wherein the inner free end of the inner portion of the cover strip is provided with a grip portion to facilitate removal of said cover strip from the pouring opening.

7. In a packing container as claimed in claim 1 the improvement wherein the intermediate portion of the cover strip extends to about 1–4 mm. inside the edge of the top of the packing container while the distance between the tearing indication and the outer end of the intermediate portion is from about 2–8 mm.

* * * * *